US006739696B2

(12) United States Patent
Arai et al.

(10) Patent No.: US 6,739,696 B2
(45) Date of Patent: May 25, 2004

(54) APPARATUS AND METHOD FOR CLEANING INK JET PRINTER

(75) Inventors: Kenichiro Arai, Suwa (JP); Noboru Otsuki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/126,253

(22) Filed: Apr. 19, 2002

(65) Prior Publication Data

US 2002/0175970 A1 Nov. 28, 2002

(30) Foreign Application Priority Data

Apr. 20, 2001 (JP) ..... 2001-123407
Apr. 20, 2001 (JP) ..... 2001-123408

(51) Int. Cl.[7] ..... B41J 2/165
(52) U.S. Cl. ..... 347/33; 347/29
(58) Field of Search ..... 347/29, 22, 32, 347/33; 15/250.361, 256.5; 101/155

(56) References Cited

U.S. PATENT DOCUMENTS 5,381,169 A 1/1995 Arai et al.
5,896,143 A * 4/1999 Matsui et al. ..... 347/24
6,158,840 A 12/2000 Kobayashi et al.

FOREIGN PATENT DOCUMENTS

| | | |
|---|---|---|
| EP | 0 867 296 A2 | 9/1998 |
| EP | 0 913 263 A1 | 5/1999 |
| JP | 4-320852 | 11/1992 |
| JP | 08-039828 | 2/1996 |
| JP | 10-323988 | 12/1998 |
| JP | 2000-141672 | 5/2000 |

* cited by examiner

*Primary Examiner*—Shih-Wen Hsieh
(74) *Attorney, Agent, or Firm*—Mark P. Watson

(57) ABSTRACT

A maintenance apparatus wipes the nozzle surface of a print head using a wiper having no ink adhering thereto. The maintenance apparatus has a wiper that moves in a direction towards and away from the plane of the nozzle surface of a print head that travels bidirectionally widthwise to the printing paper. A remover removes foreign matter on the wiper when the wiper is moved while in contact with the rake part of the remover.

14 Claims, 12 Drawing Sheets

(a)

(b)

APPARATUS AND METHOD FOR CLEANING INK JET PRINTER

BACKGROUND OF THE INVENTION

1. Field of the Invention

The present invention relates generally to an apparatus for maintaining an inkjet printer, and relates more specifically to technology for cleaning the nozzle surface of an inkjet head using a wiper.

2. Description of the Related Art

Inkjet printers print by discharging ink drops to a desired position from plural nozzles in a print head mounted on a bidirectionally travelling carriage.

Ink, dust, and other foreign matter adheres to the nozzle surface of the print head during printing, and the print head must therefore be cleaned at appropriate intervals while in a position outside of the printing area. One way to clean the nozzle surface is, for example, to provide a rubber wiper extending outside the nozzle surface of the print head and to move the print head across the wiper with the wiper deflected in contact with the nozzle surface so that the wiper wipes any ink and other foreign matter from the nozzle surface.

With this method, however, foreign matter removed from the nozzle surface of the print head by the wiper in this wiping process clings to the wiper. The next time the wiper with foreign matter adhering thereto wipes the nozzle surface, the foreign matter can enter the nozzles, thus clogging the nozzles or breaking the ink meniscus, resulting in dropped dots (i.e., non-printing dots).

Japanese Patent Laid-Open Publication (kokai) H8-39828 teaches an apparatus for resolving this problem by providing a blade member adjacent to the inkjet head so that when the inkjet head is moved, the blade member removes foreign matter adhering to the wiper so that the nozzle surface is cleaned with little foreign matter clinging to the wiper.

The problem with the apparatus taught in Kokai H8-39828 is that because the wiper position is constant (that is, contact between the wiper and any member contacting the wiper is constant) when the wiper wipes foreign matter from the nozzle surface and when foreign matter is removed from the wiper by the blade member, foreign matter removed from the wiper edge cannot be sufficiently removed. This means that foreign matter can still be transferred from the wiper to the nozzle surface when the wiper wipes the nozzle surface.

A further problem is that when the wiper returns from the deflected position to the normal non-deflected position when the wiper separates from the nozzle surface of the print head, foreign matter adhering to the wiper is flung from the wiper, thus soiling the inside of the printer and the print medium (such as paper). This is particularly a problem as printer size decreases.

OBJECTS OF THE INVENTION

The present invention is directed to a solution to this problem, and an object of the invention is to provide a maintenance apparatus able to wipe the nozzle surface of a print head with a wiper having no foreign matter adhering thereto.

A further object of the invention is to provide a maintenance apparatus able to prevent dispersion of foreign matter adhering to the wiper inside the device.

SUMMARY OF THE INVENTION

To achieve these objects, a maintenance apparatus according to the present invention has a drive mechanism for bidirectionally moving a print head having a nozzle surface in which are formed a plurality of nozzles; a wiper for wiping contamination from the nozzle surface; a remover connected for movement with the print head for wiping contamination from the wiper; a drive mechanism for moving the wiper in the direction of the plane of the nozzle surface from a standby position; and a control unit that controls the drive mechanisms so as to stop the wiper at a first position and to move the print head to a position where the print head is engaged by the wiper to remove contamination from the nozzle surface, and so as to stop the print head at a specific position and to move the wiper to a position where the wiper is engageable by the remover to remove contamination from the wiper.

By stopping the print head at a specific position and moving the wiper while the wiper is engaged with the remover so that the remover removes ink and foreign matter adhering to the wiper, foreign matter clinging to the wiper will not disperse in the direction of print head travel. Dirtying the inside of the unit is therefore reduced as compared with the prior art whereby the wiper is cleaned by moving the print head.

The control unit preferably controls the wiper drive mechanism to move the wiper to a second position farther beyond the plane of the nozzle surface than the first position to allow additional contamination to be removed from the wiper. This assures removal of foreign matter from a position farther from the cleaning edge of the wiper.

Yet further preferably, the print head is moved while the wiper is stopped at the second position to a position where the wiper and remover are engaged, and the wiper is then moved toward the standby position to remove the additional contamination from the wiper.

Yet further preferably, the remover is positioned on the maintenance area side of the print head, the maintenance area being adjacent to the printing area.

Yet further preferably, the remover is a flexible plate. One end of the remover is fixed to one side of the print head so that the remover forms a cantilever and the other free end forms a gap between the remover and the side of the print head. The wiper can be inserted to this gap between the print head and remover. By moving the wiper with the wiper while positioned between the print head and remover, ink and foreign matter adhering to the wiper can be removed.

A rake member for contact the wiper is preferably formed at the free end of the remover. When the wiper is then moved while in contact with the rake member, elastic force commensurate with deflection of the remover enables the rake member to wipe foreign matter from the wiper. In addition, the rake member meets the wiper after the wiper cleans and then separates from the nozzle surface, thereby preventing foreign matter on the wiper from scattering.

Yet further preferably, the rake member of the remover is at a position spaced apart by a certain distance from a plane defined by the nozzle surface in the direction opposite to the direction in which said wiper moves from its standby position to its first or second position. By thus slightly recessing the end (rake member) of the remover from the nozzle surface, the remover is prevented from contacting the printing paper when the print head moves through the printing area.

A wiper cleaner (second remover) for wiping contamination from the wiper is further preferably positioned on a side of the print head opposite to the side that the remover is positioned. This second remover removes a certain amount of foreign matter from the wiper through simple movement of the print head. The process for moving the wiper to clean the wiper with the first remover described above can thus be performed less frequently.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a maintenance apparatus according to the present invention and a printer comprising this maintenance apparatus is described below with reference to the accompanying figures.

Figure 1:
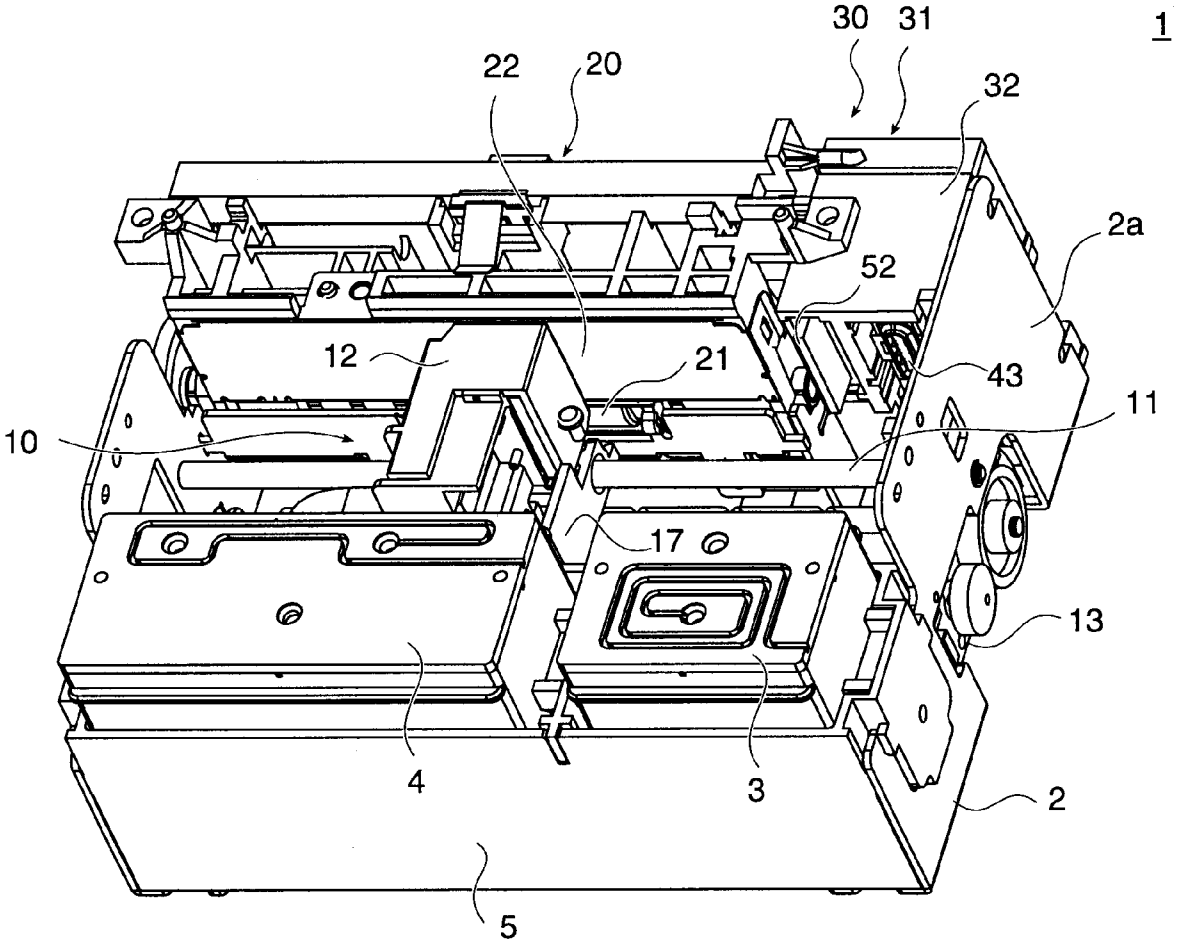
FIG. 1 is an oblique view showing the basic configuration of a printer according to the present invention.
Figure 2:
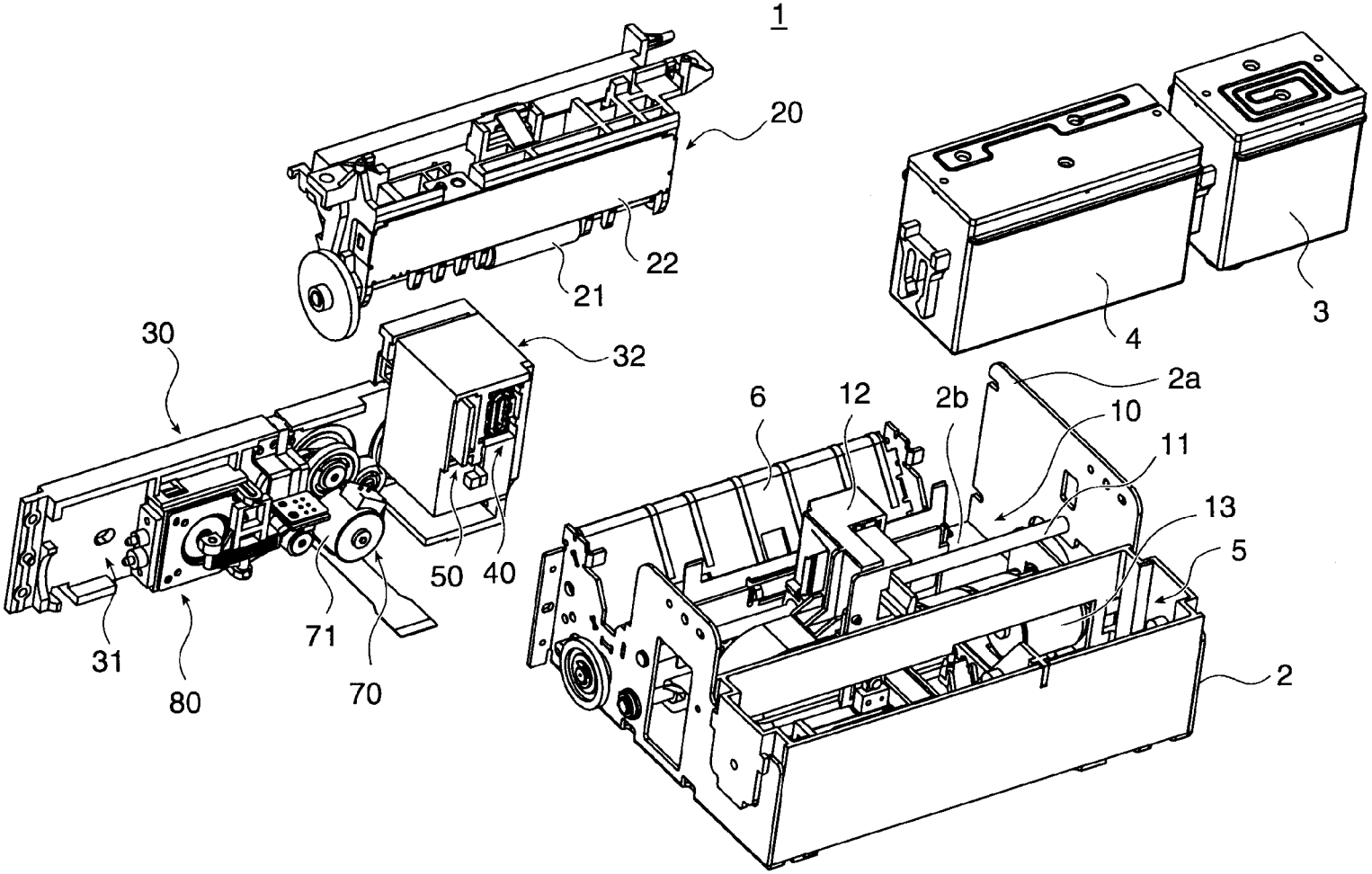
FIG. 2 is an oblique view showing the printer in FIG. 1 partially disassembled.
Figure 3:
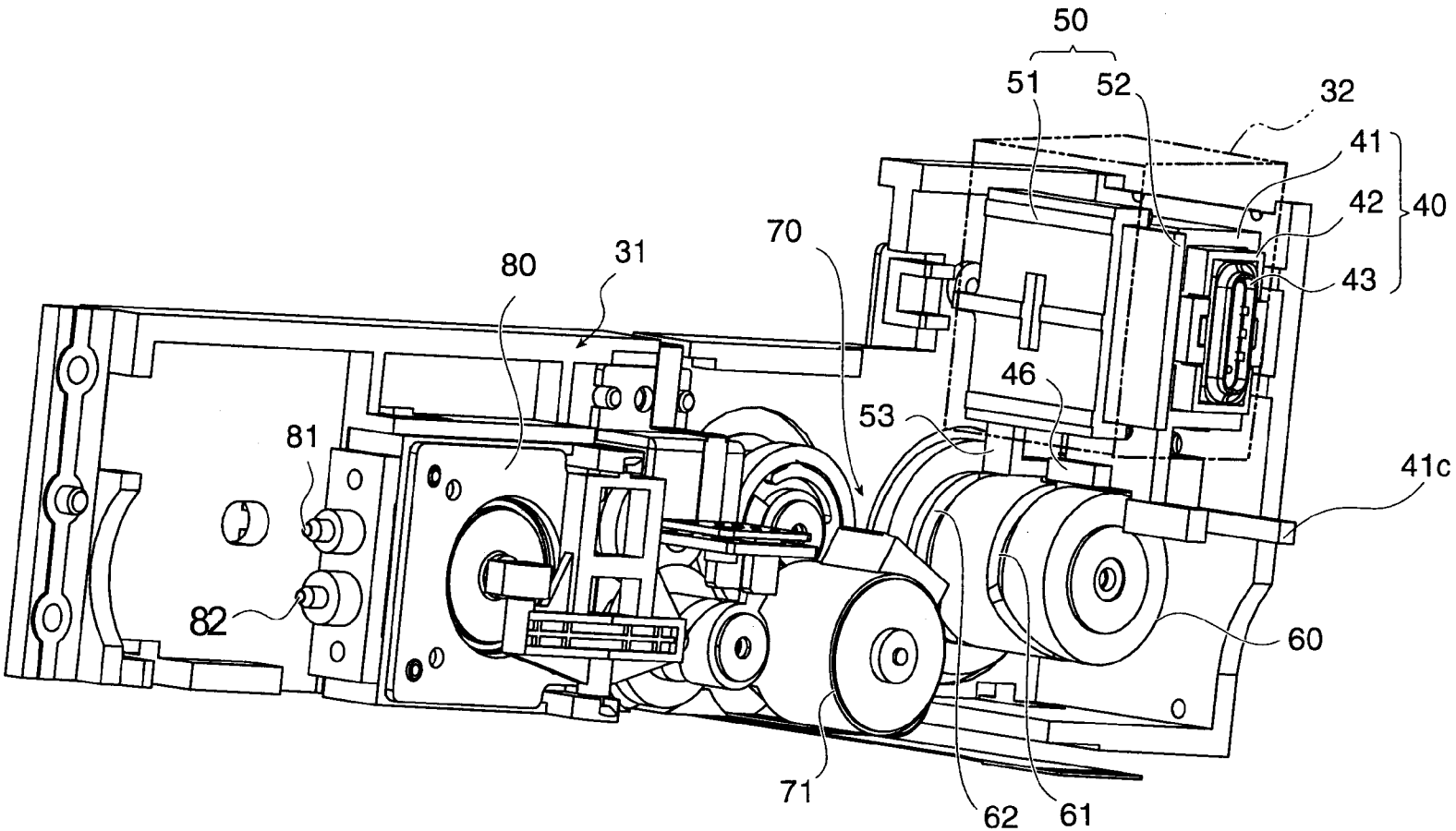
FIG. 3 is an oblique view showing the basic configuration of a maintenance apparatus according to the present invention.
Figure 4:
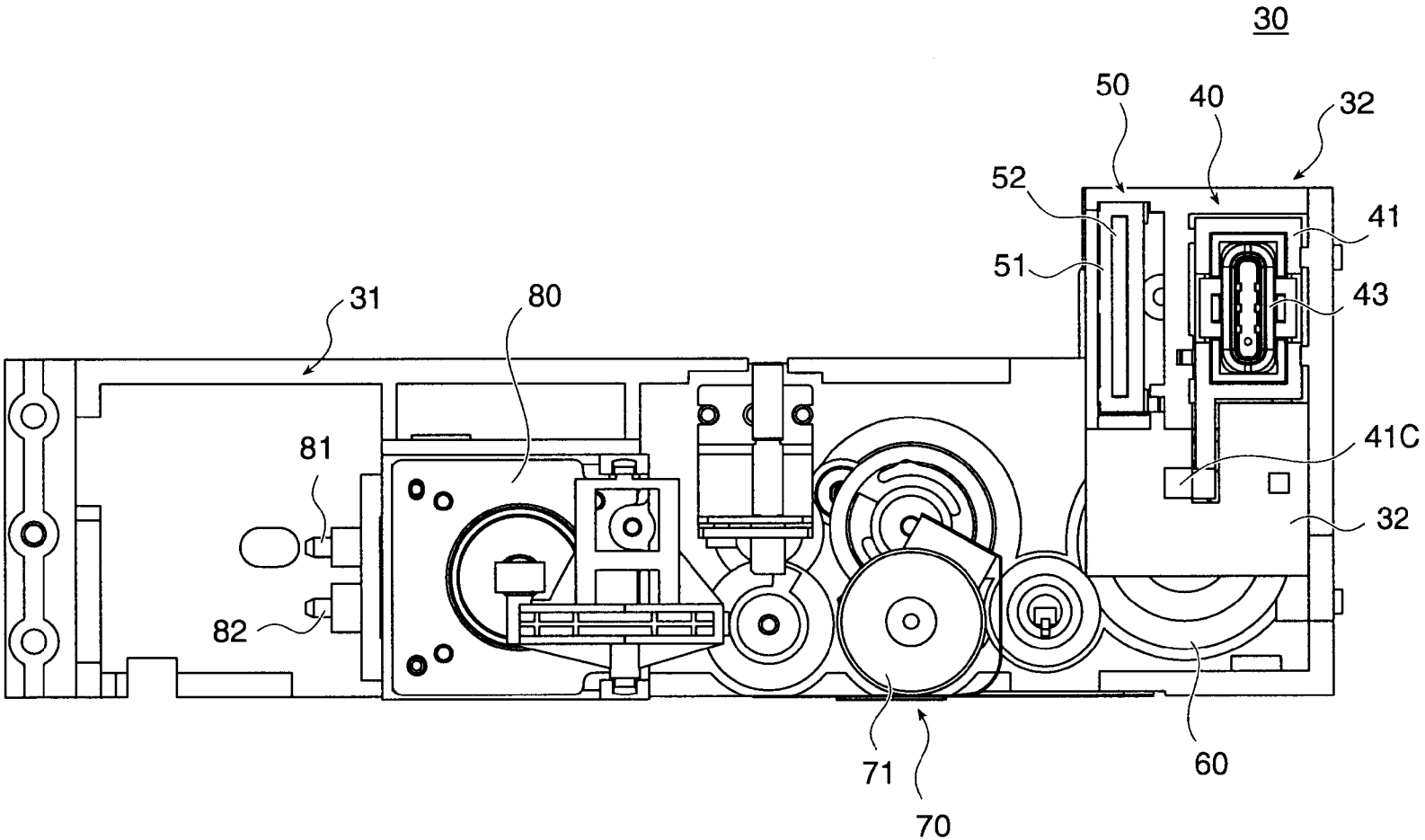
FIG. 4 is a plan view of the maintenance apparatus shown in FIG. 3.
Figure 5:
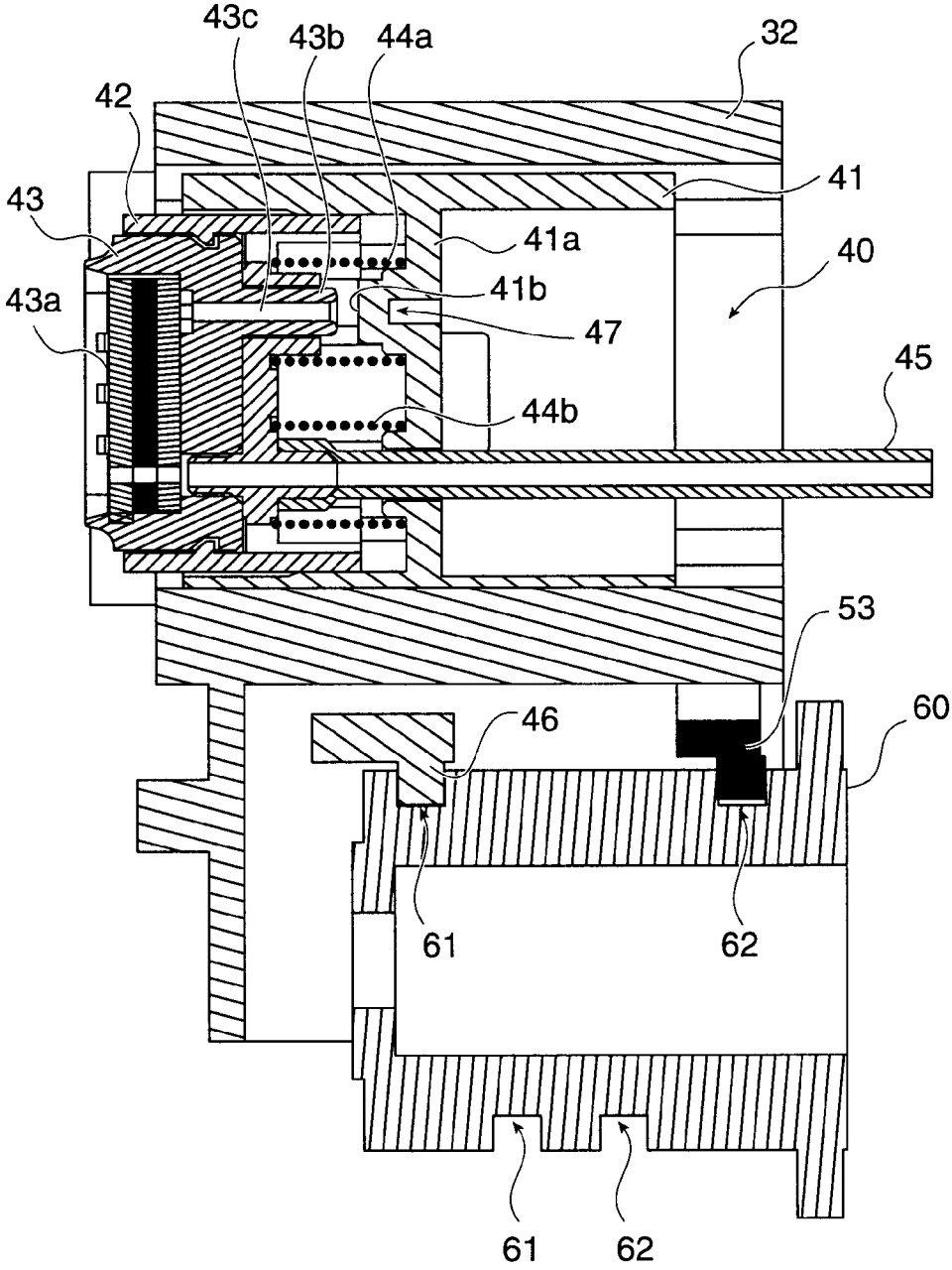
FIG. 5 is a section view showing the capping mechanism and cam member of the maintenance apparatus shown in FIG. 4.
Figure 6:
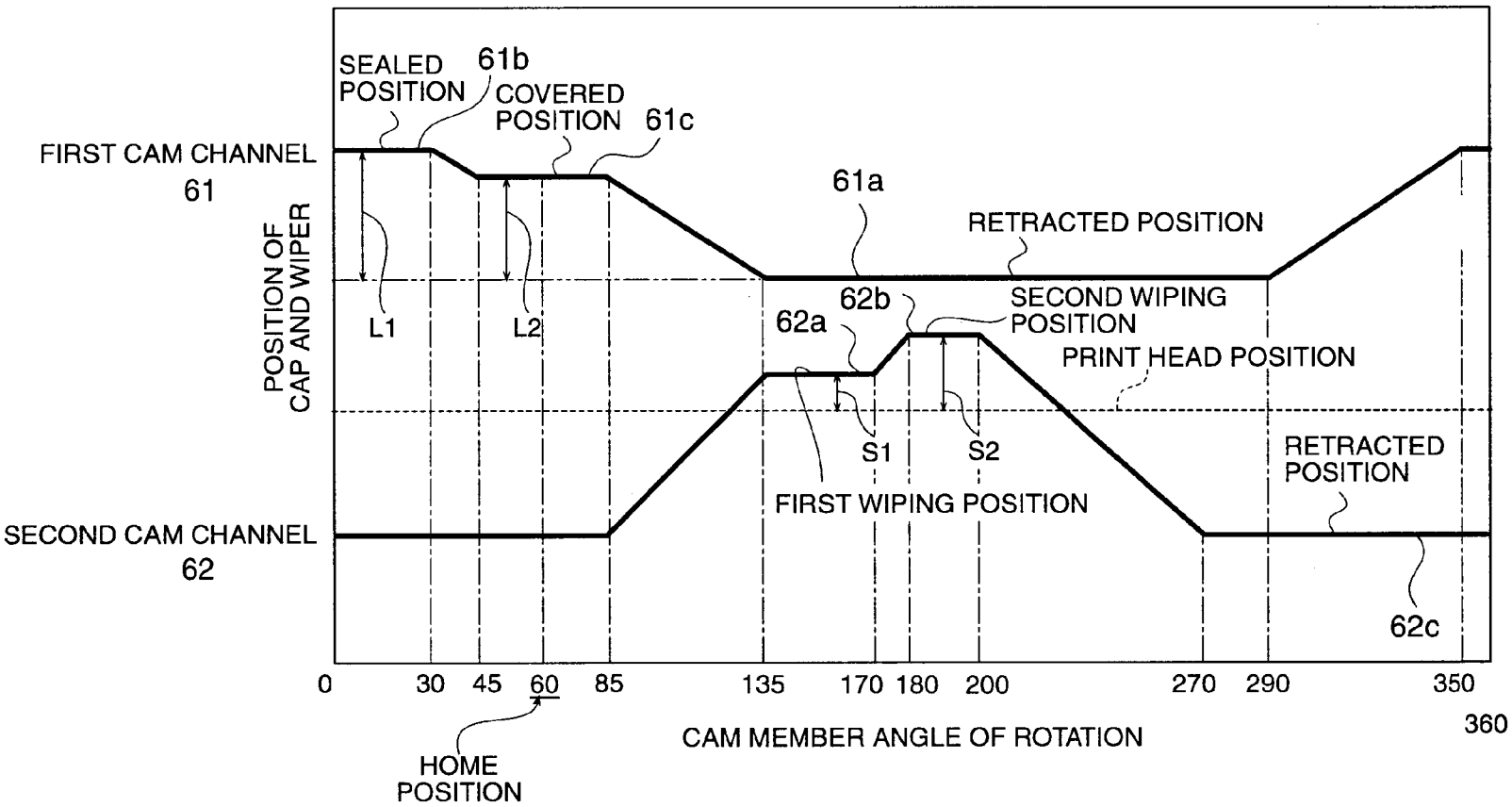
FIG. 6 is a cam diagram showing the first cam groove and second cam groove of the cam member shown in FIG. 5.
Figure 7:
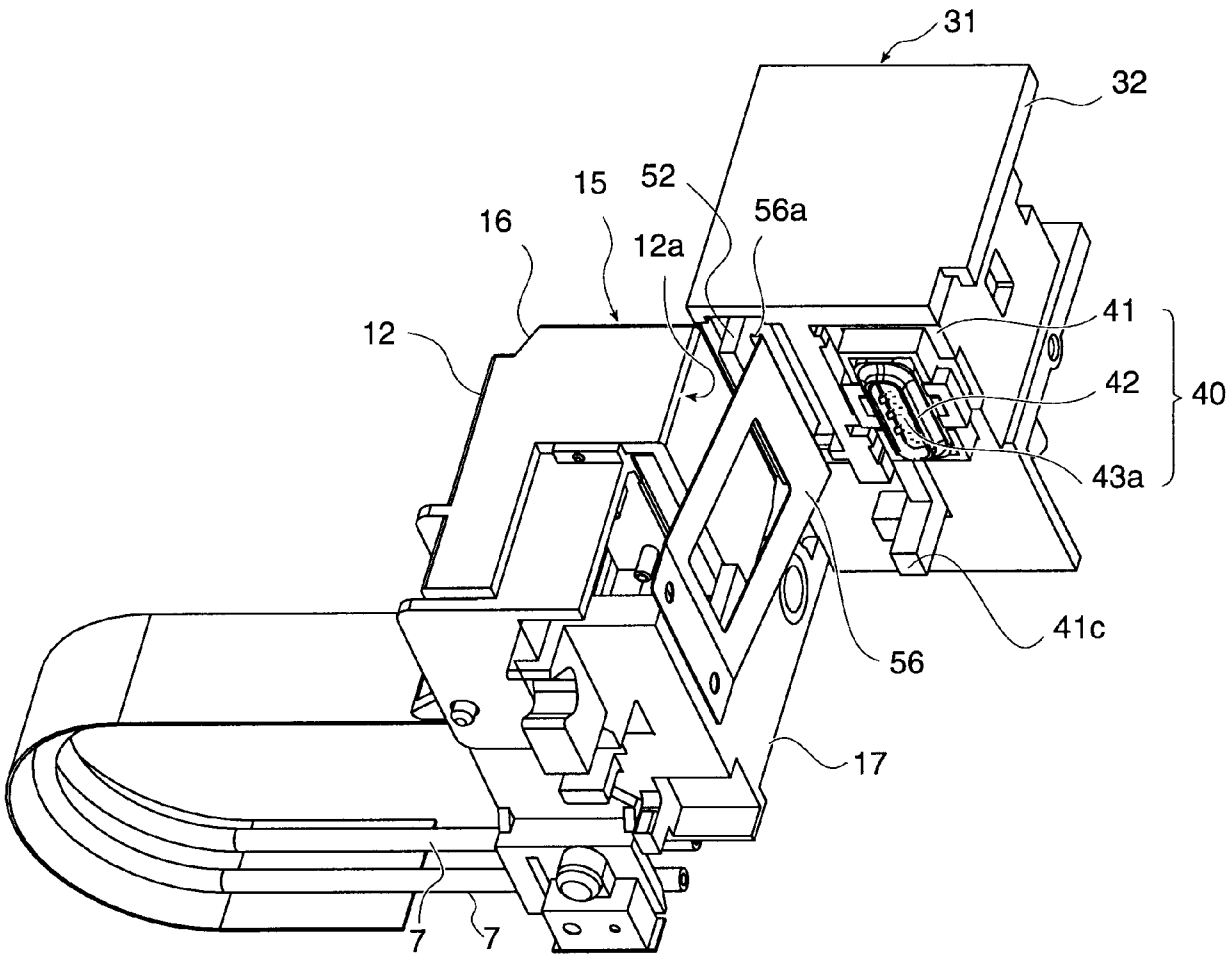
FIG. 7 is an oblique view showing essential components of the print head mechanism, capping mechanism, and wiper mechanism of the printer shown in FIG. 1.
Figure 8:
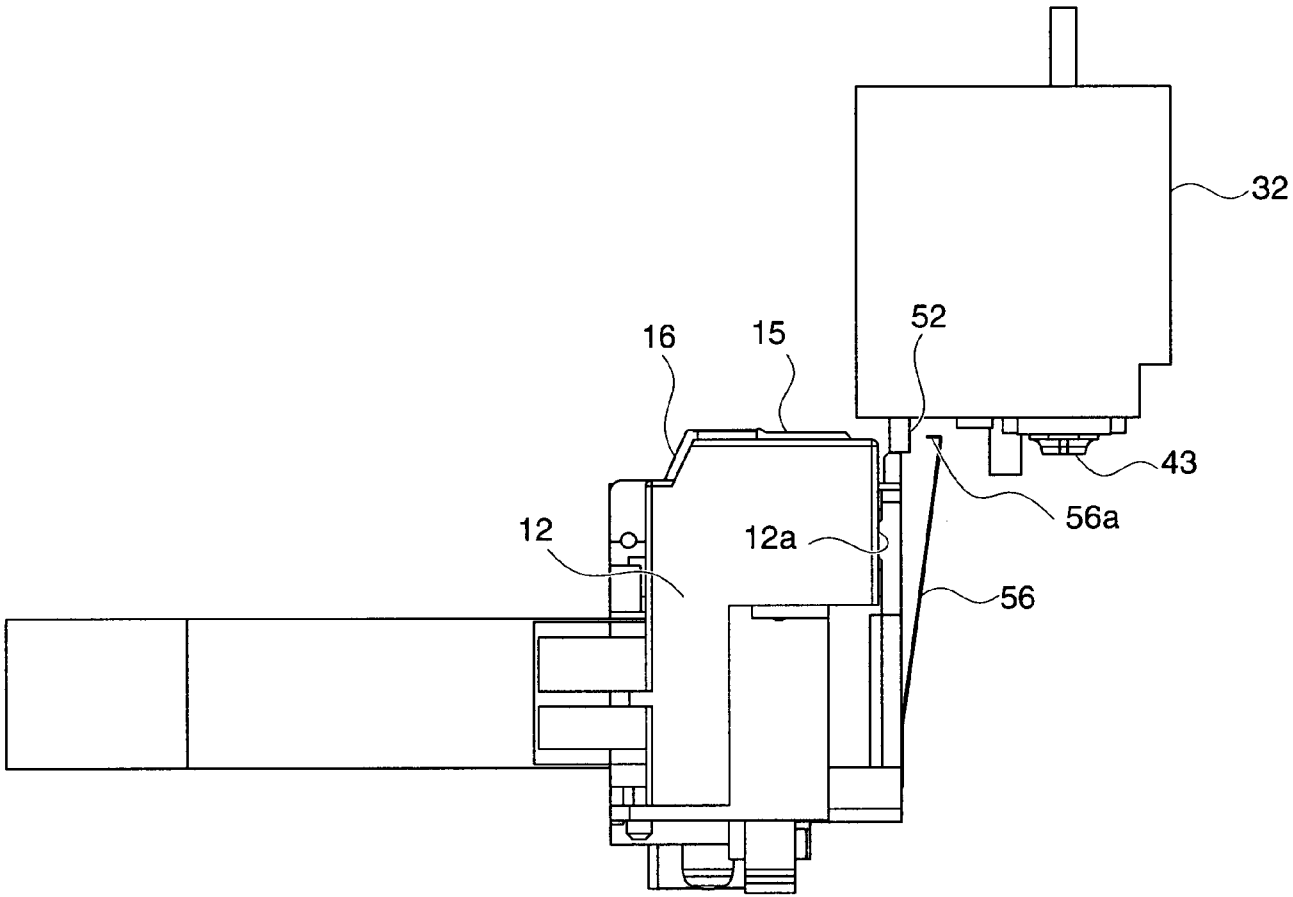
FIG. 8 is a plan view of the components shown in FIG. 7.

FIG. 1 is an oblique view showing the basic configuration of a printer according to this embodiment of the invention. FIG. 2 is an oblique view showing the printer in FIG. 1 partially disassembled. FIG. 3 is an oblique view showing the basic configuration of a maintenance apparatus according to the present invention. FIG. 4 is a plan view of the maintenance apparatus shown in FIG. 3. FIG. 5 is a section view showing the capping mechanism and cam member of the maintenance apparatus shown in FIG. 4. FIG. 6 is a cam diagram showing the first cam groove and second cam groove of the cam member shown in FIG. 5. FIG. 7 is an oblique view showing essential components of the print head mechanism, capping mechanism, and wiper mechanism of the printer shown in FIG. 1. FIG. 8 is a plan view of the components shown in FIG. 7.

As shown in FIG. 1 and FIG. 2, a printer 1 according to this embodiment of the invention has a box-like main frame 2 with a print head drive mechanism 10 disposed in the middle of the main frame 2. The print head drive mechanism 10 has a carriage shaft 11 extending lengthwise to the main frame 2. A carriage 17 is movably supported on the carriage shaft 11.

A block-shaped print head 12 is mounted on the carriage 17. A nozzle surface 15 (shown in FIG. 7 and FIG. 8) with a plurality of nozzles is formed on the front of the print head 12 so that ink supplied through ink tubes 7 (FIG. 7) can be selectively discharged from individual nozzles.

The carriage 17 on which the print head 12 is mounted is moved bidirectionally along carriage shaft 11 by driving a motor 13.

As shown in FIG. 1 and FIG. 2, a cartridge holder 5 in which ink cartridge 3 and ink cartridge 4 can be loaded and unloaded is positioned at the back of the main frame 2 (the bottom in FIG. 1 and FIG. 2). Ink cartridge 3 is filled with a first color ink (such as black ink). Ink cartridge 4 is internally separated into an ink supply chamber and waste ink chamber (not shown in the figure). The ink supply chamber is filled with a second color ink (such as red ink). An absorbent body for absorbing waste ink is contained in the waste ink chamber. The first and second colors of ink are supplied from the ink cartridges 3 and 4 to the print head 12 when the ink cartridges 3 and 4 are installed to the cartridge holder 5.

A paper guide 6 and paper feed mechanism 20 are located in the front (top as seen in FIG. 1 and FIG. 2) of the main frame 2. The paper guide 6 and paper feed mechanism 20 are both a specific length shorter than the carriage shaft 11; that is, are approximately the same length as the width of the printing paper, and are positioned offset a specific distance from one side 2*a* of the main frame 2 so as to leave a specific space therebetween.

The paper feed mechanism 20 advances printing paper located on or guided by the paper guide 6 between the print head 12 and an opposing platen 22 by driving a motor 23 (shown in FIG. 12) to rotate paper feed roller 21.

The maintenance apparatus 30 is positioned at the front of the main frame 2 so as to occupy the space between the paper feed mechanism 20 and main frame side 2*a*. More specifically, with reference to FIG. 2, the maintenance apparatus 30 has an L-shaped substrate 31, motor 71, pump 80, capping mechanism 40, wiper mechanism 50, and power transfer mechanism 70 for transferring drive power from the motor 71 to the capping mechanism 40, wiper mechanism 50, and pump 80. The capping mechanism 40 and wiper mechanism 50 are positioned between the paper feed mechanism 20 and side 2*a* of main frame 2, and the power transfer mechanism 70 and pump 80 are both disposed between paper feed mechanism 20 and the bottom 2*b* of the main frame 2.

A case-like support unit 32, open in part, is integrally formed with the substrate 31. The capping mechanism 40 and wiper mechanism 50 are supported by the support unit 32. When the print head drive mechanism 10, paper feed mechanism 20, and maintenance apparatus 30 are assembled on the main frame 2, the printing area is at the front of the platen 22 in the paper feed mechanism 20 and the maintenance area is at the front of the support unit 32 supporting the capping mechanism 40 and wiper mechanism 50. The print head 12 can move along the carriage shaft 11 between the printing area and maintenance area. The nozzle surface 15 is opposite the platen 22 when the print head 12 is in the printing area, and is opposite cap 43 or wiper 52 when the print head 12 is in the maintenance area.

The power transfer mechanism 70 for transferring drive power from the motor 71 to the capping mechanism 40, wiper mechanism 50, and pump 80 is a gear train comprising multiple gears. When the motor 71 turns in the normal (forward) direction, drive power is transferred to the pump 80; when the motor 71 turns in the opposite (reverse) direction, power is transferred to the capping mechanism 40 and wiper mechanism 50.

The intake opening 81 of the pump 80 (FIG. 3) is connected to the cap 43 through a tube 45 (FIG. 5), and the outlet 82 is connected to the waste ink chamber of the ink cartridge 4 through a tube not shown in the figures. When the pump 80 is driven ink is suctioned from the nozzles of the print head 12 through the cap 43 and discharged into the waste ink chamber of the ink cartridge 4.

Referring to FIGS. 3, 4, and 5, a cylindrical cam 60 is connected to the last stage (the capping mechanism 40 and wiper mechanism 50 side) of the gear train in the power transfer mechanism 70. A first cam channel 61 (first cam part) for sliding the cap 43, and a second cam channel 62 (second cam part) for sliding the wiper 52, are separately formed on the circumferential surface of the cam 60. The cam 60 is thus part of the capping mechanism 40 and part of the wiper mechanism 50.

More specifically as further described below, a cam follower 46 for engaging the cam channel 61 is formed on the slider 41 of the capping mechanism 40 (further described below), and a cam follower 53 for engaging the cam channel 62 is formed in the slider 51 of the wiper mechanism 50. The slider 41 of capping mechanism 40 and the slider 51 of wiper mechanism 50 thus slide according to cam channels 61 and 62 when cam 60 rotates.

The capping mechanism 40 has a slider 41, cap holder 42, and cap 43. The slider 41 is shaped like a case and is supported by the support unit 32 so as to slide orthogonally to the carriage shaft 11; that is, in the direction moving toward and away from the nozzle surface 15 of the print head 12.

As shown in FIG. 5, one end of the slider 41 is open. A divider 41*a* formed in the middle inside the slider 41 divides the slider 41 into a front and a rear section. The cap holder 42 is supported in the front section so that it can slide relative to the slider 41. The cap 43 is affixed to the front of the cap holder 42. The cap 43 is a box-shaped elastomeric structure with an opening of a size able to cover the nozzles of the print head 12. A multilayer ink absorbent body 43*a* is disposed in this opening.

As also shown in FIG. 5, a valve mechanism 47 for opening and closing a valve communicating with the cap 43 is disposed between the cap 43 and slider 41 so that the inside of the cap 43 can be cut off from or opened to the air. A tube 43*b* extending in the sliding direction of the cap holder 42 is disposed at the back part of the cap 43. A through-hole 43*c* enabling the space inside the cap 43 to communicate with the air is provided in the tube 43*b*. A valve head 41*b* that can contact the end face of tube 43*b* forming a valve seat and close the through-hole 43*c* is disposed in the divider 41*a* of slider 41. A compression spring 44*a* is disposed between the cap 43 and the slider 41 surrounding tube 43*b* and the valve 41*b*. Note that tube 45 communicating with the pump 80 is disposed at the back of the cap 43 and another compression spring 44*b* is disposed around this tube 45 between the cap 43 and slider 41.

The through-hole 43*c* is opened and closed by sliding the slider 41. The slider 41 can be positioned so that the valve is closed when the cap 43 is tight against the nozzle surface of the print head 12 (sealed position), so that the valve is open when the cap 43 is tight against the nozzle surface (covered position), or so that the cap 43 is separated from the nozzle surface of the print head 12 (retracted position).

As will be appreciated from FIG. 6, the sealed and closed positions of the cap 43 are separated distances L1 and L2 (<L1), respectively, toward the print head 12 from the retracted (standby) position. When the cap 43 is in the sealed position, the cap 43 is pinched between the slider 41 and print head, and the through-hole 43*c* is closed by valve 41*b*. When the cap 43 is in the covered position, the cap 43 is urged toward the print head by the compression spring 44, a gap of L1–L2 is created between the cap 43 and slider 41, and the through-hole 43*c* thus opens.

The shape of the cam channel 61 is determined by the relationship between the rotational angle of the cam 60 and the distance of slider 41 travel. The cam channel 61 includes three circular arc parts 61*b*, 61*c*, 61*a* for holding the cap 43 in the sealed position, covered position, or retracted (standby) position. More specifically, the cam channel 61 is a spiral channel formed on the surface of the cam 60, the spiral being formed by the circular arc parts 61*b*, 61*c*, and 61*a*. The cap 43 remains in each of these positions as the cam 60 rotates though a respective angle.

With the 0° angular position of cam 60 defined as shown in FIG. 6, cam channel part 61*a* for holding the cap 43 in the retracted position extends from 135° to 290°, cam channel part 61*b* for holding the cap 43 in the sealed position extends from 350° to 30°, and cam channel part 61*c* for holding the cap 43 in the covered position extends from 45° to 85°. Transitional parts of the spiral cam channel 61 between 30° and 45°, between 85° and 135° and between 290° and 350° interconnect these cam channels parts 61*a*, 61*b*, and 61*c*.

A lock part 41*c* (FIGS. 3 and 4) for fixing the print head 12 position is further disposed at the end of the slider 41 to hold the print head 12 in its home position.

Figure 10:
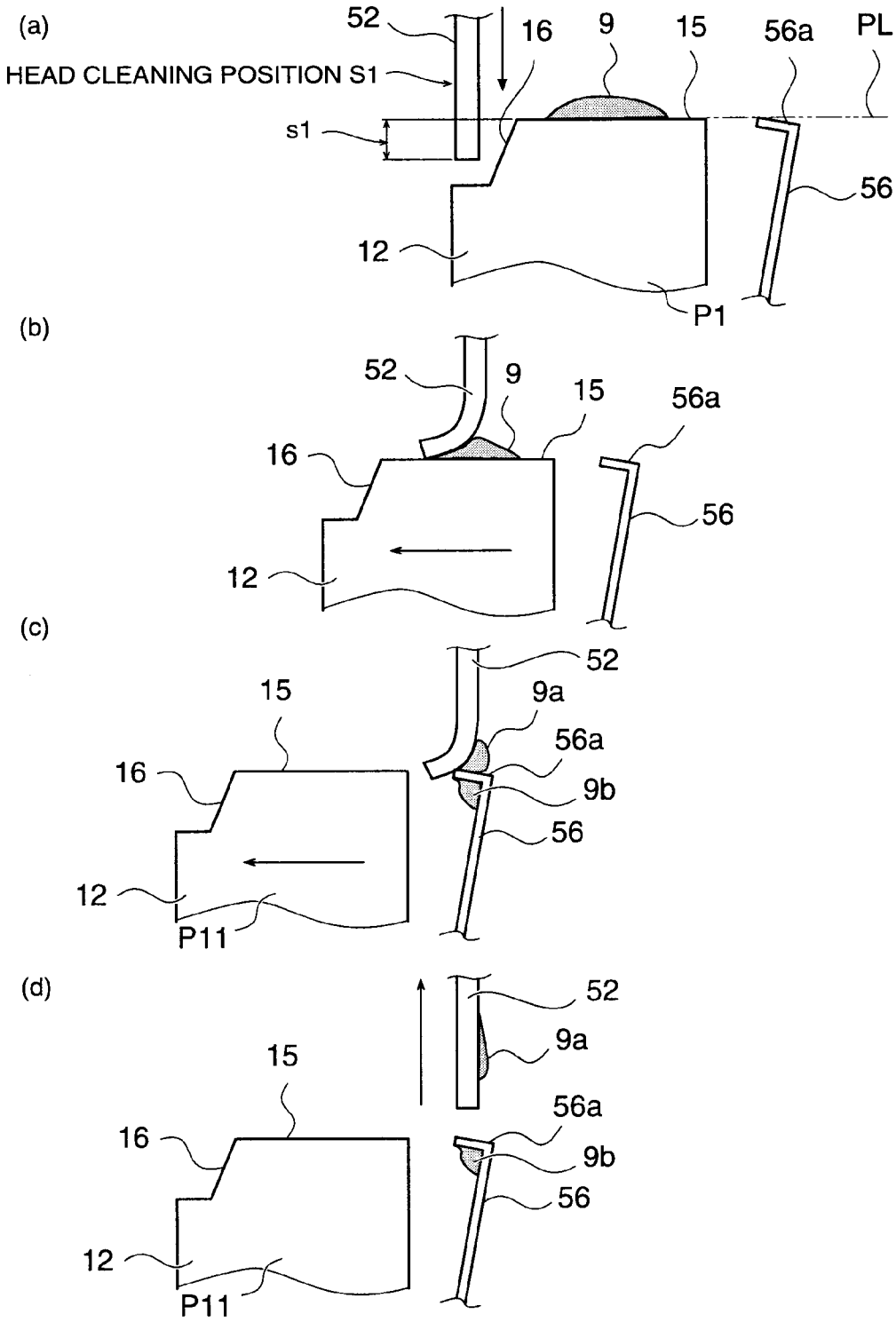
FIGS. 10(*a*) to (*d*) show the relative positions of the print head and wiper in a print head cleaning process according to the present invention.
Figure 11:
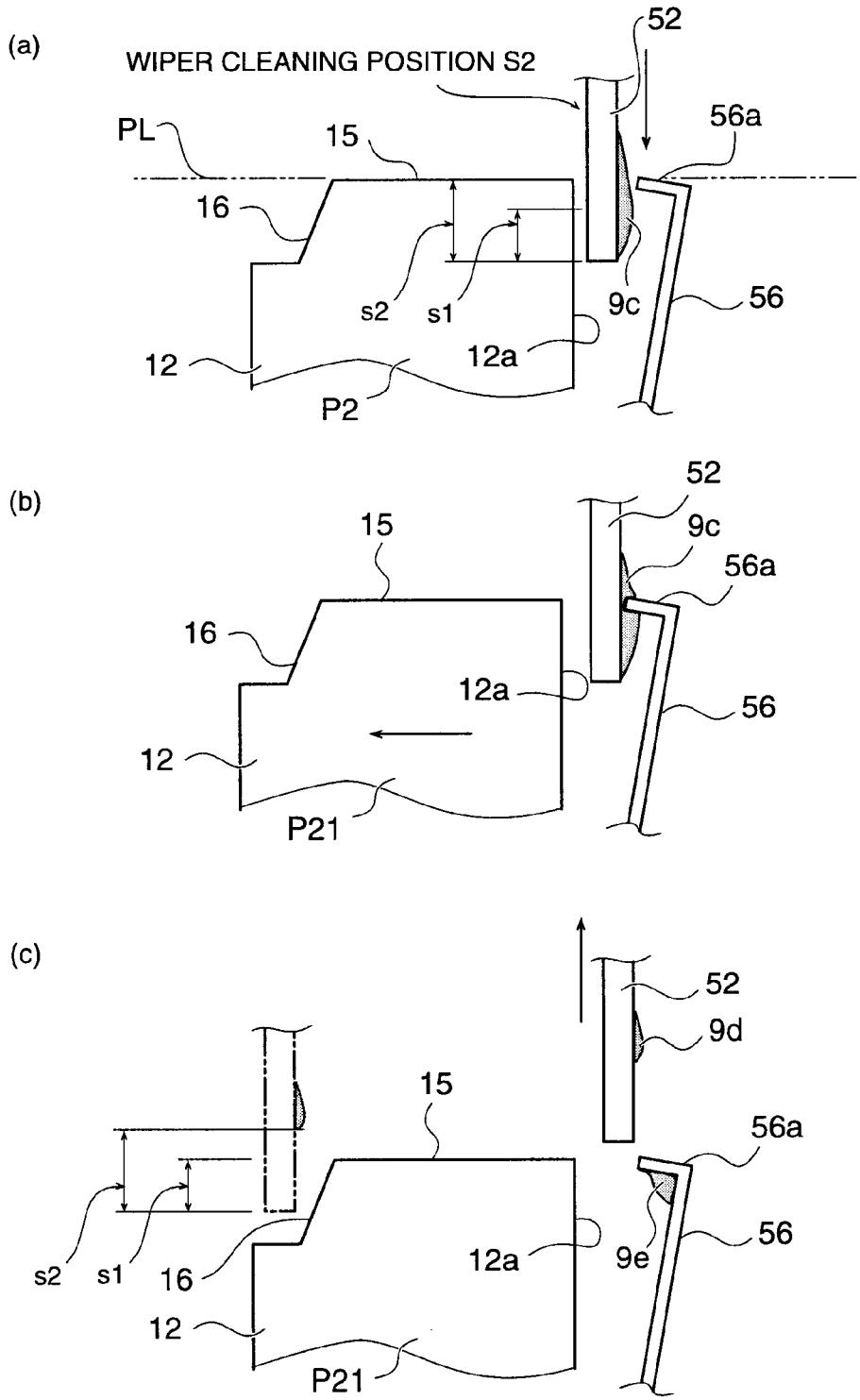
FIGS. 11(*a*) to (*c*) show the relative positions of print head and wiper in a wiper cleaning process according to the present invention.

As shown in FIG. 4, the wiper mechanism 50 has a slider 51 and wiper 52. The slider 51 is a box-shaped configuration supported on the support unit 32 so as to slide in the same direction as the slider 41 of the capping mechanism 40. An elastomeric blade-like wiper 52 is embedded in the end of the slider 51. The slider 51 can move between a retracted position at which the wiper 52 is pulled farthest inside the maintenance apparatus, a head cleaning position (first wiping position) where ink and foreign matter is wiped off the nozzle surface 15 by the wiper 52, and a wiper cleaning position (second wiping position) farther toward the print head 12 than the first position. In the head cleaning position the leading edge of the wiper 52 projects a distance s1 beyond the nozzle surface 15 toward the base of the print head as shown in FIG. 10, and in the wiper cleaning position the leading edge of the wiper 52 projects a distance s2 (s2>s1) as shown in FIG. 11.

The shape of the cam channel 62 is determined by the relationship between the rotational angle of the cam 60 and the distance slider 51 travels, similarly to cam channel 61 and the slider 41 of capping mechanism 40. More specifically, as shown in FIG. 6, the cam channel 62 is a spiral formed of three circular arc parts 62*a*, 62*b*, 62*c* for holding the wiper 52 in the head cleaning position, wiper cleaning position, and retracted (standby) position. The wiper 52 remains in each of these positions as the cam 60 rotates through a respective angle.

In this embodiment of the invention as shown in FIG. 6, cam channel part 62*c* for holding the wiper 52 in the retracted position extends from an angular position of 270° to 85°, cam channel part 62*a* for holding the wiper 52 in the head cleaning position extends from 135° to 170°, and cam channel part 62*b* for holding the wiper 52 in the wiper cleaning position extends from 180° to 200°. Transitional parts of the spiral cam channel 62 between 85° and 135° between 170° and 180° and between 200° and 270° interconnect these cam channels parts 62*a,* 62*b,* and 62*c.*

Cam channels 61 and 62 are correlated so that advancing and retracting the cap 43 is synchronized with advancing and retracting the wiper 52 as described below. More specifically, the cam channels 61 and 62 are formed so that when the wiper 52 is in the head cleaning and wiper cleaning positions the cap 43 is held in the retracted position, and when the cap 43 is in the sealed and covered positions the wiper 52 is held in the retracted position. Rotation of a single cylindrical cam 60 thus coordinates movement of the cap 43 and wiper 52 closer to and away from the print head 12.

In this embodiment of the invention as shown in FIG. 6, cam channels 62*a* and 62*b* determining the head cleaning position and wiper cleaning position of the wiper 52 are formed in the same range as the cam channel part 61*a* determining the retracted position of the cap 43, that is, between 135° and 290° of the rotational angle of the cam 60. In addition, cam channel parts 61*b* and 61*c* determining the sealed position and covered position of the cap 43 are disposed in the same rotational angle range as the cam channel 62*c* determining the retracted position of the wiper 52, that is, between 270° and 85°.

A detector 72 (shown in FIG. 12) for detecting the home position of the cam 60 is also positioned on the substrate 31. A home position is defined as the 60° rotational angle of the cam 60 as shown in FIG. 6. The positions of the cap 43 and wiper 52 are determined by rotating the cam 60 referenced to this home position. As explained in the preceding description of the present embodiment, cam channels 61 and 62 of the cam 60 cause cap 43 and wiper 52 to slide in conjunction with each other, thereby enabling printer size to be reduced and the mechanisms to be simplified compared with the prior art.

As shown in FIG. 7, a substantially L-shaped remover 56 is formed from a thin metal sheet with a specific flexibility. One end of this remover 56 is fastened to maintenance area side 12*a* of the print head 12 so that the remover 56 is cantilevered at a specific angle to the side 12*a*. The edge of the free end of the remover 56 is bent to the inside (toward the side 12*a*) like a hook to form a rake member 56*a* for raking ink and foreign matter from the wiper 52. The wiper 52 can thus be inserted between the rake 56*a* and side 12*a* of print head 12.

The rake 56*a* is positioned slightly below the plane of the nozzle surface 15 of print head 12 so that when the print head 12 moves through the printing area the remover 56 does not contact the printing paper on the platen 22.

At one edge of the nozzle surface 15 a wiper cleaner (second remover) 16 for wiping ink from the wiper 52 is formed. More particularly, as best shown in FIGS. 7 and 10, a step is formed at a certain depth away from the nozzle surface 15 on the side of the print head 12 opposite to the side 12*a* at which the remover 56 is disposed. The wiper cleaner 16 is a sloped surface that connects the step to the nozzle surface 15 and is effective to remove to some extent foreign matter adhering to the wiper 52 by simply moving the print head 12 as will be described in detail later. The cleaning effect of the wiper cleaner 16 can reduce the frequency of the cleaning process in which the wiper 52 is moved for cleaning by the remover 56.

Figure 9:
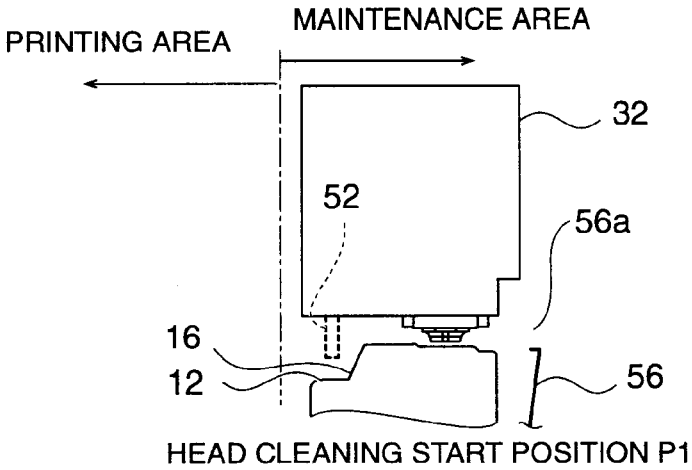
FIGS. 9(*a*) and (*b*) show the relative positions of the print head and wiper mechanism in a cleaning process according to the present invention.
Figure 9:
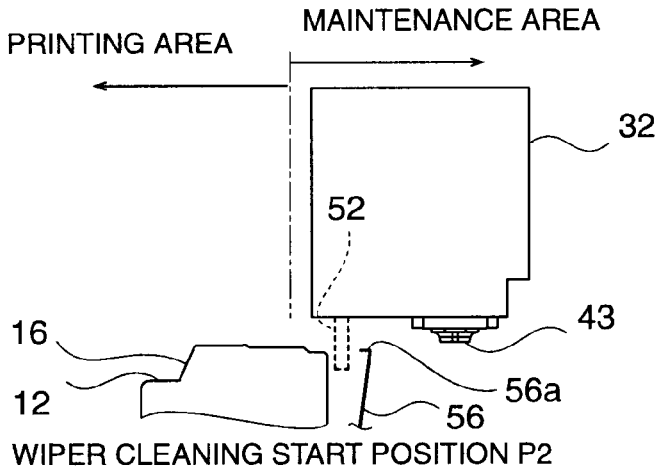
Figure 12:
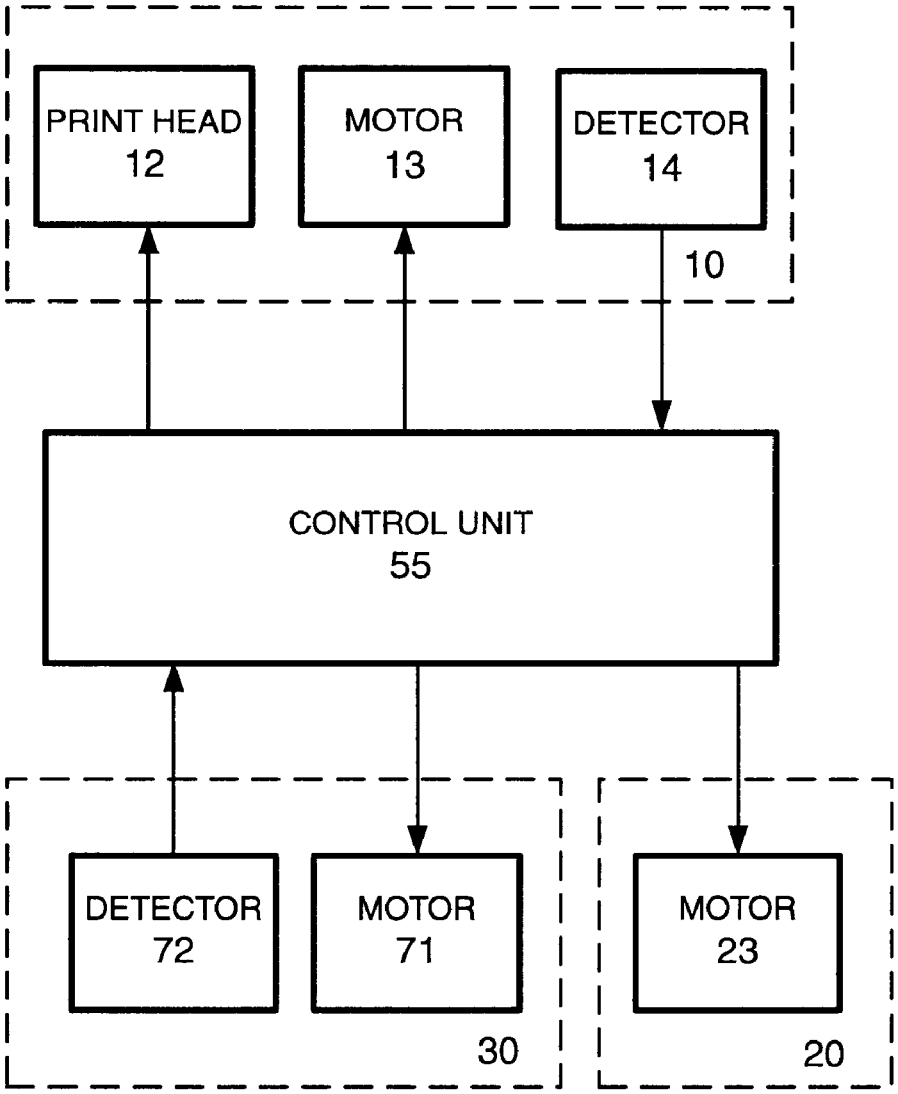
FIG. 12 is a block diagram showing the control system of a printer according to the present invention.

FIG. 12 is a block diagram showing the control system of a printer according to this embodiment of the invention. As shown in FIG. 9 the control unit 55 controls the print head 12 of the print head drive mechanism 10 and motor 13 for moving the print head 12 positioned on the carriage 17, motor 23 for the paper feed mechanism 20, and motor 71 for the maintenance apparatus 30. These motors 13, 23, and 71 are stepping motors. The control unit 55 controls the various mechanisms by appropriately applying pulse signals to the motors 13, 23, and 71. The control unit 55 primarily comprises a microprocessor mounted on a circuit board, firmware for controlling the mechanisms, and ROM, RAM, or other memory for storing and running the firmware.

The control unit 55 controls positioning of the print head 12 in the widthwise direction of the printing paper by controlling the rotary amount of motor 13, and controls the rotational angle of the cam 60 by controlling the rotary amount of motor 71. The detector 14 is positioned within the range of movement of print head 12 for detecting the absolute position of the print head 12. Positioning control of the print head 12 is based on output from the detector 14. Rotational angle control of the cam 60 is based on output from detector 72, thus controlling the positions of the wiper 52 and cap 43.

The control unit 55 also controls driving the pump 80 to vacuum ink from the print head 12 and discharge the ink to the waste ink chamber of the ink cartridge 4 by driving the motor 71 in the normal (forward) direction when the cap 43 is in the sealed position.

FIGS. 9(*a*) and (*b*) show the relative positions of the print head and wiper mechanism in a print head and wiper cleaning process according to the present invention.

FIGS. 10(*a*) to (*d*) show the relative positions of the print head, remover, and wiper in a print head cleaning process according to the present invention.

FIGS. 11(*a*) to (*c*) show the relative positions of print head, remover, and wiper in a wiper cleaning process according to the present invention.

The maintenance method according to this embodiment of the invention includes a print head cleaning process for wiping ink and foreign matter adhering to the nozzle surface 15 of the print head 12, a wiper cleaning process for removing foreign matter adhering to the wiper 52, and a nozzle purging process for sucking ink from inside the nozzles of the print head 12 to prevent or remove nozzle clogging. It should be noted that when a printing process is not running, or more specifically when the print head 12 is in the standby position, the cap 43 of capping mechanism 40 is in the covered position and the wiper 52 of the wiper mechanism 50 is in the retracted position.

For the nozzle purging process the control unit 55 moves the cap 43 from the covered position to the sealed position. More specifically, the control unit 55 drives the motor 71 by a number of pulses equivalent to the desired rotary angle, causing the cam 60 to turn a specific angle of rotation (60°→10° in FIG. 6). The direction of rotation of motor 71 is then changed to drive the pump 80. The through-hole 43*c* is thus closed by valve 41*b* of slider 41 and the nozzle surface of the print head 12 is completely sealed by the cap 43 at this time so that driving the pump 80 lowers the pressure inside the cap 43, thereby sucking ink from inside the nozzles. The ink is then expelled through tube 45 to the waste ink chamber of the ink cartridge 4.

After driving the pump 80 for a specified time the control unit 55 stops motor 71 and again changes the direction of motor rotation, then drives the cam 60 a specific angle (10°→60° in FIG. 6) and returns the cap 43 from the sealed position to the covered position. The control unit 55 then again changes the direction of rotation of motor 71 and again drives the pump 80. While the nozzle surface of print head 12 is covered by the cap 43 at this time the through-hole 43*c* is open. Driving the pump 80 therefore does not suck ink from the nozzles but rather discharges only the ink held in the absorbent body 43*a* of the cap 43 through tube 45 into the waste ink chamber of the ink cartridge 4. The control unit 55 then stops the motor 71 and ends the nozzle purging process after the pump 80 eliminates an amount of ink collected in the absorbent body 43*a* of the cap 43. It should be noted that the cap 43 is left in the covered position in order to prevent variation in the pressure inside the cap 43 due to temperature changes and to prevent disruption of the ink meniscus inside the nozzles when the printer is not used for a long time.

The print head cleaning process when the print head 12 is in the standby position starts with the control unit 55 moving the wiper 52 from the retracted position to the head cleaning position S1 where the wiper 52 extends distance s1 beyond the plane PL of the nozzle surface 15 of the print head 12. More specifically, the control unit 55 drives the motor 71 the number of pulses equivalent to the desired wiper 52 travel distance, causing the cam 60 to turn a specific angle of rotation (60°→150° in FIG. 6). This rotation of the cam 60 also moves the cap 43 to the retracted position.

When in this head cleaning position the wiper 52 is opposite the wiper cleaner 16 of the print head 12 as shown in FIG. 9(*a*) and FIG. 10(*a*). The control unit 55 then drives the motor 13 of the print head drive mechanism 10 a specific pulse count to move the print head 12 from the maintenance area toward the printing area. More specifically, the print head 12 moves from the head cleaning start position P1 shown in FIG. 9(*a*) to the wiper cleaning start position P2 shown in FIG. 9(*b*).

As the print head 12 moves, the wiper 52 first contacts the wiper cleaner 16 of the print head 12 and then bends an amount determined by distance s1 as it slides over the nozzle surface 15 of the print head 12 as shown in FIG. 10(*b*), thereby transferring ink adhering to the nozzle surface 15 to the wiper 52 and thus removing it from the nozzle surface 15. Note that the wiper cleaner 16 scrapes across the surface of the wiper 52 and can thus remove an amount of ink remaining on the wiper 52 when the wiper 52 rides up over the wiper cleaner 16 before sliding across nozzle surface 15.

The print head 12 then moves toward the printing area, causing the wiper 52 to separate from the nozzle surface 15 of the print head 12 as shown in FIG. 10(*c*), and stops at position P11, at which point the wiper 52 is in contact with the rake 56*a* of the remover 56. When the wiper 52 contacts the rake 56*a* of remover 56 it remains bent as when sliding across the nozzle surface 15.

With the print head 12 stopped at position P11 the control unit 55 moves the wiper 52 from the head cleaning position S1 to the retracted position as shown in FIG. 10(*d*). More specifically, the control unit 55 drives the motor 71 by a pulse count equivalent to the desired travel distance to turn the cam 60 a specific angle of rotation (150°→60° in FIG. 6). When the wiper 52 moves toward the retracted position, ink 9*b* is removed by the rake 56*a* from a length of the end of the wiper 52 approximately equal to distance s1 and held by the remover 56. Ink at a distance greater than length s1 from the end of the wiper 52 remains on the wiper 52. The wiper 52 separates gradually from the remover 56 and thus returns slowly from the bent position to the normal position, thereby preventing ink 9*a* on the wiper 52 and ink 9*b* on the remover from being propelled off the wiper or remover and scattering.

In the wiper cleaning process the control unit 55 stops the print head 12 as shown in FIG. 9(*b*) so that when the wiper 52 moves to the wiper cleaning position S2 the wiper 52 is positioned between the remover 56 and side 12*a* of print head 12 (wiper cleaning start position P2).

The control unit 55 next moves the wiper 52 from the retracted position to the wiper cleaning position S2 at which the wiper 52 projects distance s2 beyond the plane PL of the nozzle surface 15 of the print head 12 as shown in FIG. 11(*a*). More specifically, the control unit 55 drives the motor 71 by a pulse count equivalent to this distance s2 to drive the cam 60 a specific rotational angle (60°→190° in FIG. 6). The free end of the wiper 52 thus advances past the nozzle surface 15 of the print head 12 and enters the gap formed between the remover 56 and side 12*a* of print head 12.

As shown in FIG. 11(*b*), the control unit 55 then drives the motor 13 of print head drive mechanism 10 by a specific pulse count to move the print head 12 to position P21 where the rake 56*a* of remover 56 contacts wiper 52. This causes the remover 56 to deflect slightly.

As shown in FIG. 11(*c*), the control unit 55 then drives the motor 71 to turn the cam 60 a specific angle of rotation (190°→60° in FIG. 6) so as to move the wiper 52 from the wiper cleaning position S2 toward the retracted position. As the wiper 52 separates from the rake 56*a* of remover 56, the elastic force corresponding to the deflection of the remover 56 enables the rake 56*a* to scrape part 9*e*, equivalent to distance s2, of the ink 9*c* adhering to the wiper 52 from the wiper 52.

The amount of ink 9*d* remaining on the wiper 52 when the wiper 52 returns to the retracted position from the wiper cleaning position S2 is thus less than the amount of ink 9*a* remaining on the wiper 52 when it returns from the head cleaning position S1 to the retracted position. This wiper cleaning process thus makes it possible to remove ink from an area at the end of the wiper 52 greater than the area corresponding to distance s1 used for the next head cleaning process.

By thus using a remover 56 to appropriately remove ink and other foreign matter that clings to the wiper 52 when the wiper 52 wipes the nozzle surface 15 of the print head 12, the present invention is able to clean the print head with a part of the wiper 52 devoid of ink, thereby preventing clogging the nozzles of the print head 12 and the resulting dots dropouts.

Furthermore, by contacting the wiper 52 with the remover 56 immediately after it wipes the nozzle surface 15 of the print head 12, the present invention also stops ink adhering to the wiper 52 from being propelled off the wiper and scattering.

The present invention has been described using a groove formed in the circumferential surface of a cylindrical cam for moving the wiper and cap. The invention shall not be so limited, however, as a protruding rail-like member could be formed on the surface of the cylindrical cam to define the wiper and cap movement.

As described above, the present invention uses a remover to remove ink and foreign matter adhering to the wiper by moving the wiper in contact with the remover after first stopping the print head at a predetermined position, thereby preventing foreign matter on the wiper from scattering in the direction of print head travel. Compared with the prior art whereby the wiper is cleaned by moving the print head, the present invention thus reduces contamination of the inside of the unit.

The present invention can also reliably remove foreign matter from a position further removed from the edge of the wiper by advancing the wiper from a first position further in the direction of the print head to a second position. This makes it possible to even more effectively prevent clogging the print head nozzles and resulting non-printing dots.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A maintenance apparatus comprising:

a print head drive mechanism that bidirectionally moves a print head having a nozzle surface in which are formed a plurality of nozzles;

a wiper that wipes contamination from the nozzle surface;

a remover connected for movement with the print head that wipes contamination from the wiper;

a wiper drive mechanism that moves the wiper in a direction toward a plane of the nozzle surface from a standby position; and a control unit that controls the print head drive mechanism and wiper drive mechanism so as to stop the wiper at a first position and to move the print head to a position where the print head is engaged by the wiper to remove contamination from the nozzle surface, and so as to stop the print head at a specific position and to move the wiper to a position where the wiper is engageable by the remover to remove contamination from the wiper.

2. A maintenance apparatus as described in claim 1, wherein the control unit controls the wiper drive mechanism to move the wiper to a second position farther beyond the plane of the nozzle surface than the first position to allow additional contamination to be removed from the wiper.

3. A maintenance apparatus as described in claim 2, wherein the control unit controls the print head drive mechanism to move the print head while the wiper is stopped at the second position to a position where the wiper and remover are engaged, and the control unit controls the wiper drive mechanism to move the wiper toward the standby position to remove the additional contamination from the wiper.

4. A maintenance apparatus as described in claim 1, wherein the print head drive mechanism moves the print head between a printing area and an adjacent maintenance area where the wiper is positioned, and the remover is positioned on the maintenance area side of the print head.

5. A maintenance apparatus as described in claim 1, wherein the remover comprises a flexible plate having one end fixed in a cantilevered fashion such that the other free end is spaced apart from a side of the print head, the wiper being arranged to enter into a gap formed between the print head and remover.

6. A maintenance apparatus as described in claim 5, further comprising a rake member formed at the free end of the plate that contacts the wiper.

7. A maintenance apparatus as described in claim 6, wherein the rake member is at a position spaced apart by a certain distance from a plane defined by the nozzle surface in the direction opposite to the direction in which the wiper moves from the wiper standby position to the wiper first or a wiper second position.

8. A maintenance apparatus as described in claim 1, further comprising a wiper cleaner that wipes contamination from the wiper, the wiper cleaner positioned on a side of the print head opposite a side on which the remover is positioned.

9. An inkjet printer comprising:

a print head drive mechanism that bidirectionally moves a print head having a nozzle surface in which are formed a plurality of nozzles;

a wiper that wipes contamination from the nozzle surface;

a remover connected for movement with the print head that wipes contamination from the wiper;

a wiper drive mechanism that moves the wiper in a direction toward a plane of the nozzle surface from a standby position; and a control unit that controls the print head drive mechanism and wiper drive mechanism so as to stop the wiper at a first position and to move the print head to a position where the print head is engaged by the wiper to remove contamination from the nozzle surface, and so as to stop the print head at a specific position and to move the wiper to a position where the wiper is engageable by the remover to remove contamination from the wiper.

10. An inkjet printer as described in claim 9, wherein the control unit controls the wiper drive mechanism to move the wiper to a second position farther beyond the plane of the nozzle surface than the first position to allow additional contamination to be removed from the wiper.

11. An inkjet printer as described in claim 10, wherein the control unit controls the print head drive mechanism to move the print head while the wiper is stopped at the second position to a position where the wiper and remover are engaged, and the control unit controls the wiper drive mechanism to move the wiper toward the standby position to remove the additional contamination from the wiper.

12. A maintenance method for an inkjet printer having a print head drive mechanism that bidirectionally moves a print head having a nozzle surface in which are formed a plurality of nozzles, a wiper that wipes contamination from the nozzle surface, a remover connected for movement with the print head that wipes contamination from the wiper, a wiper drive mechanism that moves the wiper in a direction toward a plane of the nozzle surface from a standby position, said maintenance method comprising steps of:

moving the print head while the wiper is stopped at a first position such that the print head is engaged by the wiper to remove contamination from the nozzle surface; and moving the wiper while the print head is stopped at a specific position such that the wiper is engaged by the remover to remove contamination from the wiper.

13. A maintenance method as described in claim 12, further comprising moving the wiper to a second position farther beyond the plane of the nozzle surface than the first position to allow additional contamination to be removed from the wiper.

14. A maintenance method as described in claim 13, further comprising moving the print head while the wiper is stopped at the second position to a position where the wiper and remover are engaged, and then moving the wiper toward the standby position to remove the additional contamination from the wiper.

* * * * *